United States Patent [19]

Morland et al.

[11] Patent Number: 4,708,661

[45] Date of Patent: Nov. 24, 1987

[54] MODIFIED BNC CONNECTOR FOR ACTIVE PROBE

[75] Inventors: Mark R. Morland; Paul A. Cole, both of Portland; Ivan J. Cousins; Raymond A. Zandonatti, both of Beaverton, all of Oreg.

[73] Assignee: Tektronix, Inc., Beaverton, Oreg.

[21] Appl. No.: 889,488

[22] Filed: Jul. 28, 1986

[51] Int. Cl.[4] ..... H01R 9/09

[52] U.S. Cl. ..... 439/77; 439/314; 439/581

[58] Field of Search ..... 339/17 F, 17 CF, 90 R, 339/193 R, 193 N, 193 P, 193 S, 193 US, 194 R, 194 N, 177 R, 177 E, 185 R; 439/77, 314, 581

[56] References Cited

U.S. PATENT DOCUMENTS

| | | | |
|---|---|---|---|
| 810,949 | 1/1906 | Kloman | 339/193 N |
| 2,419,018 | 4/1947 | Gudie | 339/193 N |
| 3,182,280 | 5/1965 | Daut et al. | 339/186 M |
| 3,523,267 | 8/1970 | Pauza | 339/17 C |
| 3,848,950 | 11/1974 | McCormick et al. | 339/90 R |
| 4,417,776 | 11/1983 | Motoyama | 339/17 F |

*Primary Examiner*—John McQuade

*Attorney, Agent, or Firm*—William O. Geny

[57] ABSTRACT

A modified BNC connector for connecting an active probe to an active probe to an electronic instrument includes a female BNC input on the instrument for cooperatively mating with the male BNC output of the probe. The female BNC input includes a flex circuit mounted on a planar surface and disposed about the periphery of its outer coaxial shield. A plastic bezel fits over the flex circuit to permit access to contact points located thereon and to mask the remaining area. The male BNC connector is located in a housing which includes a set of spring loaded telescoping pins which make contact with the flex circuit contact points. The housing includes a rotatable knob that locks the male and female portions together.

5 Claims, 6 Drawing Figures

FIG. 2
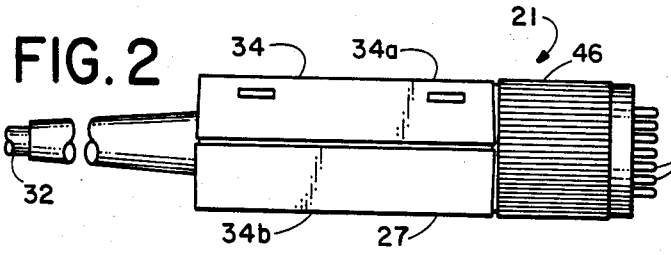
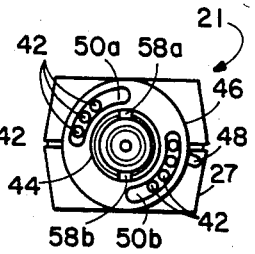
FIG. 2A
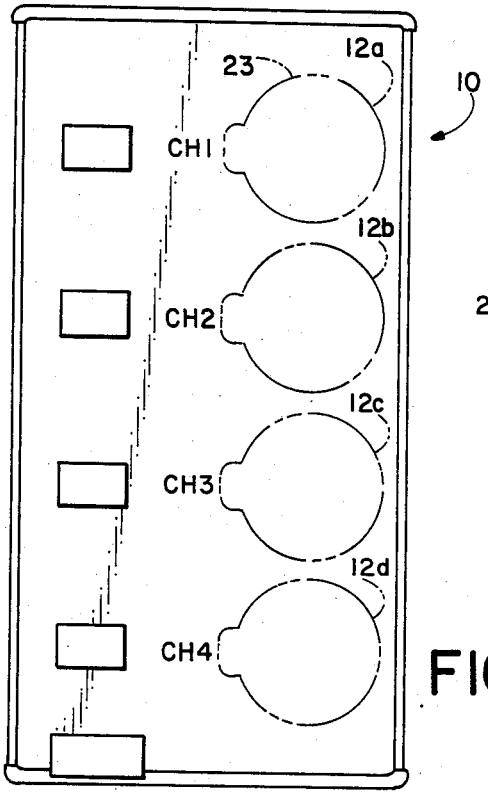
FIG. 1
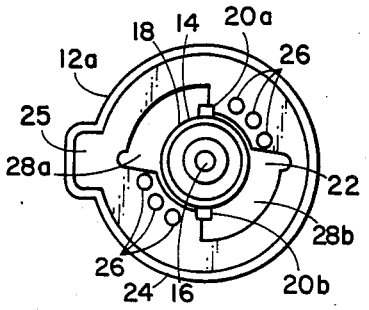
FIG. 1A
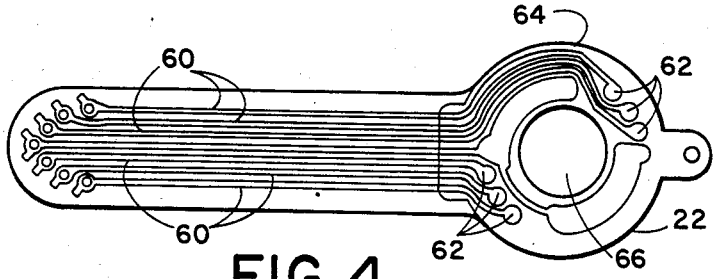
FIG. 4

MODIFIED BNC CONNECTOR FOR ACTIVE PROBE

BACKGROUND OF THE INVENTION

The following invention relates to a modified BNC connector for connecting an active probe to an electronic device such as an oscilloscope utilizing a standard BNC connection without the need for auxiliary power cables and the like.

BNC connectors are typically used on electronic instruments where a 50 ohm transmission line, connected to a probe or other peripheral device, is required to be connected to the front panel of the instrument. The probe termination is typically the male portion of a BNC connector, and the female portion of the BNC connector is situated on the front panel of the instrument.

Electronic instruments such as oscilloscopes now typically employ active probes, that is probes which include active circuitry, requiring positive and negative power supplies. With active probes the instrument may make various voltages and signals available at the probe which greatly increase the instrument's measuring capability. In order to provide the probe with these capabilities, it has been necessary in the past to connect an auxiliary cable from the probe's active circuitry, usually contained within a housing, to a location on the instrument where access may be gained to power supply components. This is awkward and inefficient because the auxiliary cable must typically be connected at the rear of the chassis, while the analog input line is connected through the conventional BNC connector on the front panel of the instrument. Moreover, it is necessary in the design of new instruments which use active probes, to retain the basic BNC input connection on the front of the instrument for those users who do not need active probes. In this way, older probes which lack the active circuitry could be used with newer model test instruments because the BNC connecting jacks would remain compatible with the older probes.

SUMMARY OF THE INVENTION

The present invention provides an apparatus for connecting an active probe to the front panel of an electronic instrument such as an oscilloscope without the need for an auxiliary power cable, while at the same time retaining the instrument's plug compatibility with older, non-active probes.

The connector comprises two cooperatively mating portions which are male and female halves of a standard BNC connection, in which one-half of the connection is disposed on the front panel of the instrument, and the other half is located at the terminating end of a probe. A circuit board which includes electrical contact points is disposed about the periphery of the BNC connector portion located on the face of the instrument. The other portion, at the termination of the probe, includes a plurality of pins, disposed about a male BNC connector, which are adapted to mate with the contact points of the circuit board located on the front panel of the instrument. A bezel located in a panel cutout surrounding the female BNC connector provides a means for masking the circuit board to prevent unwanted contact by stray wires or other objects while allowing the pins to make proper contact.

In order to assure proper alignment of respective pins and contact points, the bezel may include a slot which functions as a keyway for receiving a rib located on a rotatable knob housing the male BNC connector. The rib and slot properly orients the pins and contact points so that the connector halves are not connected upside down. The rotatable knob may be coupled to a locking key which rotates to lock the first half of the BNC connector to the second half. Since the female end of the BNC connector typically includes a pair of bayonet pins, the rotating member may include a pair of locking dogs which may slide behind the pins, thus preventing the connector from being accidentally pulled apart.

It is a principal object of this invention to provide a connector for connecting an active probe to the front panel of an electronic instrument without the necessity for auxiliary wires carrying power supply lines to power the active probe.

Yet a further object of this invention is to provide a connector for an active probe for the front of an electronic instrument which will provide all the necessary electrical requirements for the probe and yet maintain the plug compatibility of older probes with the electronic instrument.

A still further object of this invention is to provide an integral connection for an active probe which requires a minimum of space on the front panel of an electronic instrument.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a front view of the front panel of an electronic instrument which includes four input connections.

FIG. 1*a* is a front view of the female half of one of the connectors shown in FIG. 1.

FIG. 2 is a side elevation view of the male half of the connector of the present invention.

FIG. 2*a* is a front view of the male connector half of FIG. 2.

FIG. 4 is a top view of a flexible printed circuit for use in connection with the female connector shown in FIG. 1*a*.

DETAILED DESCRIPTION OF THE INVENTION

Figure 3:
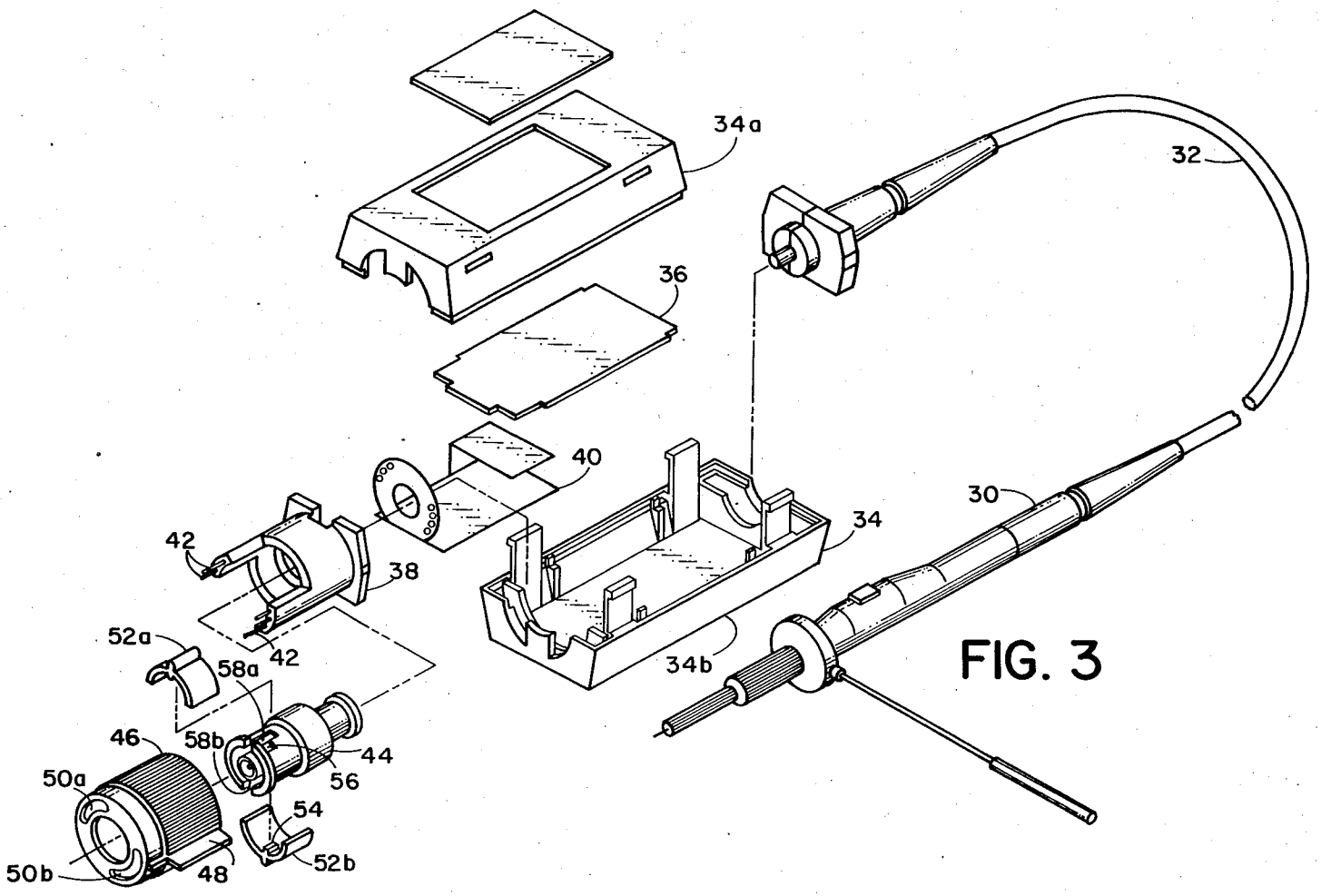
FIG. 3 is an exploded perspective view of the male connector of FIG. 2 further including a connecting cable and an active probe.

An electronic instrument 10 such as a four-channel amplifier may include four input connections 12*a*, 12*b*, 12*c* and 12*d*, respectively. FIG. 1*a* shows one of the inputs 12*a* in larger detail. The input 12*a* includes a BNC female connector 14 which includes a central socket 16 surrounded by a coaxial cylindrical shield 18. The cylindrical shield 18 includes bayonet pins 20*a* and 20*b*. Disposed about the periphery of BNC connector 14 is a flexible printed circuit 22 (shown best in FIG. 4). The printed circuit 22 is physically attached to a planar plate (not shown) from which the female BNC connector 14 protrudes. A plastic bezel 24 fits around the outside of the female BNC connector 14 in a chassis cutout 23 to mask portions of the flexible printed circuit 22. Small circular apertures 26 and two larger arcuate apertures 28*a* and 28*b* provide access to portions of the printed circuit 22 by the male half of the modified BNC connector as will be explained below.

Referring to FIGS. 2 and 2*a*, a male portion 21 of the connector includes a housing 27 which is connected to a cable 32. The housing 27 includes a circuit box 34 and a knob 46. As shown best in FIG. 3, an active probe 30 is connected by cable 32 to circuit box 34. The circuit box 34 may typically contain a printed circuit board assembly 36 which is clamped between top and bottom box halves 34*a* and 34*b*, respectively. An electrical contact carrier 38 is connected to a flex circuit 40 which is situated within the circuit box 34 and is connected to the printed circuit board assembly 36. The electrical contact carrier includes a plurality of pins 42 which are connected internally to the flex circuit 40. The pins 42 may be spring loaded telescoping pins. The electrical contact carrier 38 is cylindrical and houses within it a male half of a BNC connector 44. Situated over the outside of the electrical contact carrier and the male BNC connector 44 is rotatable knob 46 which forms the outer shell. The knob 46 includes a rib 48 and cutout portions 50*a* and 50*b* which accommodate pins 42 and still allow for approximately 25° of rotation.

Carried within knob 46 are a pair of locking keys 52*a* and 52*b*. Each of the locking keys 52*a* and 52*b* includes a dog 54 (not shown on locking key 52*a*). The locking keys 52*a* and 52*b* are moveable with the rotation of knob 46 such that the locking dogs, such as dog 54, rotate from a cutout portion 56 in BNC connector 44 to slots 58*a* and 58*b*. The slots 58*a* and 58*b* are sized to accommodate the bayonet pins 20*a* and 20*b* located on female BNC connector half 14. The bayonet pins 20*a* and 20*b* slide past the cutout portion 56, and when the knob 46 is turned, the locking dogs engage the bayonet pins 20*a* and 20*b* by moving behind them into slots 58*a* and 58*b*. The knob 46, which includes rib 48, fits into a slot 25 in bezel 24. The slot 25 provides the rib 48 with approximately 25° of rotation, which is enough to move locking keys 52*a* and 52*b* into position to lock the male BNC connector 44 to the female BNC connector 14. The dimensions of the connector halves 14 and 21 and the bezel 24 and the length of pins 42 are such that the pins 42 will not make contact with printed circuit 22 unless the rib 48 is properly aligned with slot 25. This prevents damage to circuitry in the circuit box 34 which could otherwise occur if the connectors 14 and 21 mated upside down.

FIG. 4 shows a flexible printed circuit 22 which includes a plurality of circuit paths 60 which have termination points 62 on a ring portion 64 which includes a central aperture 66 to accommodate female BNC connector 14. When the bezel 24 is fitted over the ring portion 64 of flexible circuit 22, the apertures 26 provide access to the termination points 62 for the pins 42.

The termination points 62 of the printed circuit 22 provide all of the signal and power lines necessary to power and operate active probe 30. At the same time, the basic nature of the BNC connection on the front panel remains unchanged to allow older, non-active probes to be used with the instrument.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. An electrical connector for connecting an electronic instrument with a peripheral device comprising:

(a) two cooperatively mating portions including:

(1) a first portion comprising a first half of a BNC connection having circuit means disposed about the periphery thereof on a planar surface for providing a plurality of electrical contact points arranged along an arc of a first circle concentric with said first half of said BNC connection;

(2) a second portion comprising a second half of a BNC connection held within a cylindrical carrier means, said carrier means including a plurality of pins extending therefrom disposed about the periphery of said second half of said BNC connection along an arc of a second circle concentric with said second half of said BNC connection corresponding in position to said first circle wherein said pins are thereby adapted to mate with said electrical contact points on said circuit means; and (b) bezel means for masking portions of said circuit means and containing apertures for providing access to said circuit means by said pins whereby said pins are guided onto said corresponding contact points.

2. The electrical connector of claim 1 wherein said first portion is situated on a planar panel of said electronic instrument, and said second portion is the terminating end of said peripheral device.

3. The electrical connector of claim 1 wherein said bezel means includes a slot for receiving a keying rib located on a housing for said second portion such that said pins are properly oriented with respect to said circuit means.

4. The electrical connector of claim 3 wherein said housing encloses said cylindrical carrier means and includes locking means actuated by rotation thereof to lock said second portion to said first portion.

5. The electrical connector of claim 4 wherein said locking means comprises a pair of dogs movable with said housing to retain a pair of pins located on said first half of said BNC connection when said housing is rotated into a locking position.

* * * * *